US005372058A

United States Patent [19]

Petrovich et al.

[11] Patent Number: 5,372,058

[45] Date of Patent: Dec. 13, 1994

[54] LAUNCH PACKAGE ELEMENT SEATER

[75] Inventors: Paul A. Petrovich, Fowlerville; Rene G. Gonzalez, Southfield; Steven L. Hoffman, Howell, all of Mich.

[73] Assignee: The United States of America as represented by the Secretary of the Army, Washington, D.C.

[21] Appl. No.: 96,244

[22] Filed: Jul. 26, 1993

[51] Int. Cl.[5] ..... F41A 9/42

[52] U.S. Cl. ..... 89/47; 86/21

[58] Field of Search ..... 86/20.15, 21, 43; 89/33.05, 47; 102/313

[56] References Cited

U.S. PATENT DOCUMENTS

| | | | |
|---|---|---|---|
| 133,040 | 11/1872 | Lavalle | 86/21 |
| 852,900 | 5/1907 | Peay et al. | 86/21 |
| 2,703,528 | 3/1955 | Lee et al. | 102/313 |
| 5,233,124 | 8/1993 | Peterson | 86/43 |

*Primary Examiner*—Stephen C. Bentley

*Attorney, Agent, or Firm*—Peter A. Taucher; David L. Kuhn

[57] ABSTRACT

Disclosed is a launch element seater for repeatably placing projectiles or other launch package elements at an exact location within a breech of a gun. The seater includes a tube closely fit and slidable in the breech and a plate for precisely locating the tube on the breech, the plate encircling the tube and opposing a reference surface on the breech. An internally threaded terminus of the tube threads with a rod entering the tube, and the rod joins a seat member fit closely and slidably in the breech. A positionable set nut threaded on the rod outside the tube locates the innermost position of the rod relative to the tube and thereby locates the seat member and a projectile engaged thereto within the breech.

19 Claims, 1 Drawing Sheet

LAUNCH PACKAGE ELEMENT SEATER

GOVERNMENT USE

The invention described herein may be manufactured, used and licensed by or for the U.S. Government for governmental purposes without payment to us of any royalty thereon.

BACKGROUND AND SUMMARY

Often it is necessary to test launch package elements such as projectiles or shells for quality or for design effectiveness. One common method of testing launch package elements is to fire them under standardized conditions. Similarly, armor can be tested by firing projectiles at it under standardized conditions and then examining the armor for type and extent of damage. In either case, variance of the launch package element's location in the gun breech can cause error in test results. Since launch package elements are normally squeezed in the cylindrical cavity of the breech, a certain degree of force is needed to axially reposition them within the cavity. This force, typically applied by tapping the package element, often moves the element too far, whence it is necessary to repeat the repositioning until the desired accuracy is achieved. If the launch package has a sabot and penetrator, the tapping can bounce the penetrator away from the sabot, so that the sabot slams against the penetrator upon firing the launch package, possibly damaging the package, harming the gun, and affecting test accuracy.

The difficulty of properly seating a projectile is greater when placing the launch package in a rifled test gun. The launch package must be shoved into the breech forcefully enough to engrave the package with the rifling of the gun barrel, but must be very accurately placed to achieve consistency in test conditions. Failure to advance the package into sufficient engravement with the gun barrel may cause the launch package to Jam in the gun breech when the test gun is fired. Jamming occurs during firing if the launch package propellant's pressure does not overcome the package's initial engravement force and static friction with the gun breech or barrel. If the launch package is not engraved at all with the rifling during seating, the package may skew out of concentricity with the gun barrel as it first contacts the rifling grooves upon firing, thereby introducing error into the test results.

Our launch element seater is a device that improves the efficiency and accuracy with which a launch package element can be placed within a breech. The invention includes a tube having a seat member at one end for pushing a launch package element part of the desired axial distance into the cylindrical cavity of a breech. The head pushes the element until a breech plate on the tube abuts the breech, whereby the tube is precisely located relative to the breech. While the tube is so located, a human operator turns a threaded rod extending from the tube and connected to the head. The rod advances the head from the tube slowly, without jerking, to accurately push the launch package element to a desired position. Our seater also includes means to detect when advancement of the seat member from the tube is at the desired distance and to prevent subsequent advancement of the seat member.

DETAILED DESCRIPTION

Figure 1:
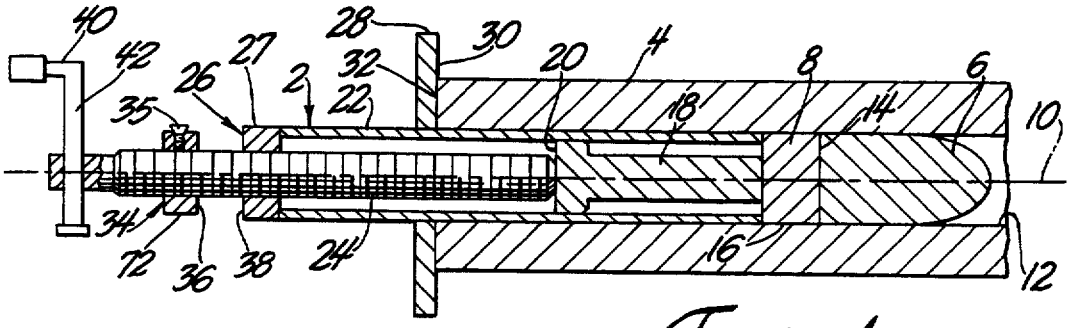
FIG. 1 is a longitudinal sectional view of one end of a gun breech having a first embodiment of the launch element seater engaged therewith.

FIG. 1 shows the first, preferred embodiment of our launch package element seater 2 engaged with breech 4 of a smooth bore cannon (not shown) and a launch package element 6 within the breech. The launch package element is typically a projectile or shell that fits closely in the breech with a slight friction so that the element will not slide if the breech is tilted but can easily be moved along the breech via manual force. Axially abutting the launch package element is a cylindrical seat member 8 concentric with axis 10 and closely fit with the inner diametrical wall 12 of the breech. Member 8 has flat, smooth launch package element engagement surface 14 perpendicular to axis 10 and has a smooth outer periphery 16 faced against wall 12. Wall 12 may define a forwardly tapered throat adjacent anterior breech surface 32 to ease entry of launch package element 6 into the breech.

A stem 18 centered on axis 10 is affixed at one end to seat member 8 and is affixed at the opposite end to a cylindrical guide 20, which is closely and slidably engaged with the inner diametrical surface of metal tube 22. Tube 22 itself fits closely and slidably within breech 4. Affixed to guide 20 is threaded rod 24 coaxial with the tube and centered on axis 10, rod 24 extending from the tube through tube terminus 26.

Tube terminus 26 is internally threaded complimentarily to rod 24, is fixedly abutted to tube 22 and has an outer diametrical surface 27 whose radius is the same as the adjoining outer diametrical surface of tube 22. Fixed to and surrounding tube 22 at the end of the breech is a disk-like breech plate 28 whose flat, axially forward locator face 30 closely and conformingly fits against the flat anterior surface 32 at the end of breech 4.

On a portion of threaded rod 24 protruded from tube 22 is nut 34 having set screw 35 for locking the nut at a selected axial position along rod 24. Nut 34 has a flat axially forward face 36 closely and conformingly abuttable against flat anterior reference surface 38 of tube terminus 26. At the outer end of threaded rod 24 is crank 40 whose shank 42 is radially translatable relative to rod 24.

To operate seater 2, launch package element 6 is first manually inserted into breech 4 at the open end, which is the left in FIG. 1. A person grasping the outer end of tube 22 abuts surface 14 of seater 2 against the rear of the launch package element, and then uses seater 2 to advance the element further into the breech. The launch package element is advanced until forward face 30 of breech plate 28 bears against anterior breech surface 32 as shown in FIG. 1. The person then holds plate 28 against surface 32 while turning crank 40, so that seat member 8 separates from tube 22 and advances launch package element 6 still further in the breech. The person continues cranking until set nut 34, which is in a preselected fixed position on threaded rod 24, contacts tube terminus 26.

For placement of launch package elements in a smooth bored breech, it is preferred that the exterior of tube 22 adjacent terminus 26 and outer diameter 27 of the terminus define a smooth continuous hand grip surface. When using seater 2 to push launch package element 6 into breech 4, a person will grip tube 22 such that a gap is left between the person's hand and plate 28. As a rule of thumb for smooth bore breeches, if the person's hand slips toward the plate while pushing the launch package element with seater 2, then the fit between the launch package element and the breech is too tight. Thus the smooth, continuous hand grip surface is a means to test for overly tight fit of launch package element 6 in a smooth bored breech.

Figure 2:
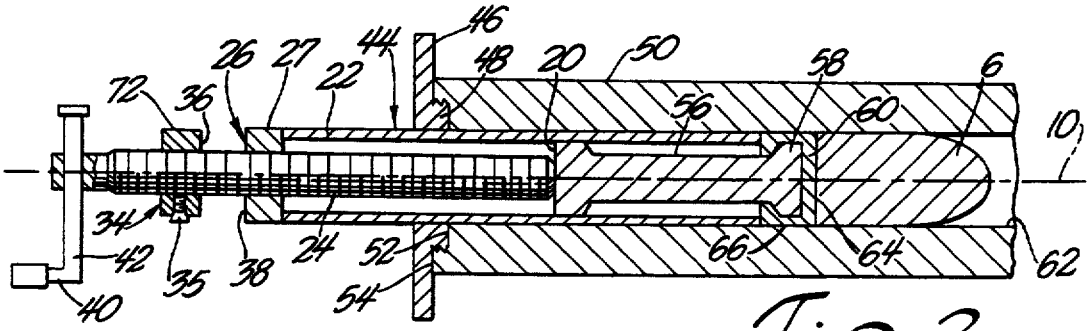
FIG. 2 is a longitudinal sectional view of one end of a gun breech having a second embodiment of the launch element seater engaged therewith.

In FIG. 2 is a modified version 44 of launch element seater 2, the elements common to both seaters 2 and 44 having identical reference numerals. Seater 44 has a breech plate 46 similar to breech plate 28 except that breech plate 46 includes an externally threaded annulus 48 to engage breech 50. Breech plate 46 and breech 50 are precisely co-located by their respective flat, annular reference surfaces at interfaces 52 and 54. Breech 50 differs from breech 4 in that breech 50 is rifled, has a forwardly tapering throat and defines a threaded blind bore to receive annulus 48.

Stem 56 of seater 44 is similar to stem 18 of seater 2 except that stem 56 has a round head 58 closely fit within and freely rotatable with cylindrical seat member 60. Seat member 60 axially abuts launch package element 6, is concentric with axis 10 and closely fits with the inner diametrical wall 62 of breech 50. Member 60 has a flat, smooth, relatively friction free launch package element engagement surface 64 perpendicular to axis 10 and a smooth outer periphery 66 faced against wall 62. The rotational connection of head 58 to member 60 and the low friction of surface 64 inhibit friction between seater 44 and launch package element 6 due to their differing rotation rates when the launch package element is advanced by seater 44 in breech 50.

Figure 4:
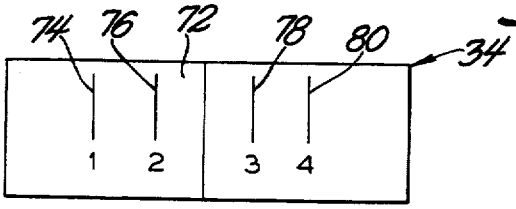
FIG. 4 top elevational view of a modified set nut for our seater with hidden lines omitted.
Figure 3:
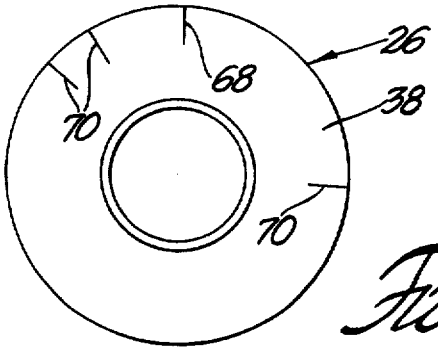
FIG. 3 is an end view of a modified tube terminus of our seater.

In FIGS. 3 and 4 are shown optional modifications to tube terminus 26 and set nut 34 which can be adapted to either the FIG. 1 or the FIG. 2 embodiment of the seater. As seen in FIG. 3, tube terminus 26 has an angular position mark 68 at the outer periphery of reference surface 38, the mark preferably being recessed or inscribed into surface 30 so as to avoid affecting the locating accuracy of this reference surface. Upon contact between nut 34 and terminus 26 when turning crank 40, shank 42 can be radially aligned with mark 68 or else put in another selected position relative to this mark, whereby the axial placement of launch package element 6 in a breech can more accurately be repeated. A plurality of additional position marks 70 can be placed on the periphery of surface 38 at selected positions. Additionally, FIG. 4 shows an outer diametrical surface zone 72 of nut 34 having inscribed thereon a scale comprised of markers 74, 76, 78 and 80. After contact between nut 34 and terminus 26, one of these markers can be aligned with position marks 68 or 70 instead of shaft 42.

Referring again to FIG. 2, launch package seater 44 optionally may have a cross sectionally polygonal extension suitable for engagement by a torque wrench (not shown). It is contemplated that the torque wrench may be used in lieu of the FIG. 3 or FIG. 4 modifications when positioning element 6. Alternatively, the torque wrench may be used to calibrate or determine torque values for marks or markers of FIGS. 3 and 4.

We wish it to be understood that we do not desire to be limited to the exact details of construction or method shown herein since obvious modifications will occur to those skilled in the relevant arts without departing from the spirit and scope of the following claims.

We claim:

1. A seater for placement of a launch package element in a breech of a gun, comprising:
- a breech longitudinal axis;
- a tube slidable in the breech along the axis;
- an internally threaded terminus at one end of the tube;
- a rod threaded through the terminus;
- means for locating the tube with respect to an open end of the breech;
- a seat member axially between the tube and the launch package element and axially fixed relative to the rod;
- means for rotating the rod so as to axially translate the seat member away from the tube;
- means for limiting the travel of the rod and seat member relative to the tube.

2. The seater of claim 1 wherein both the tube and seat member fit conformingly in, surface-to-surface relation against an inner diametrical wall of the breech.

3. The seater of claim 2, further comprising a guide axially spaced from and axially fixed relative to the seat member, at least a portion of the guide conformingly fit with a tube inner diametrical surface.

4. The seater of claim 3 further comprising a head fixed to the guide and rotatably connected to the seat member, whereby the head and the seat member can rotate relative to one another about the axis.

5. The seater of claim 1 wherein the locating means comprises:
- a first axially facing reference surface fixed to the tube;
- a second axially facing reference surface on the breech opposed to the first axially facing surface.

6. The seater of claim 5 wherein the outer diameters of the tube and terminus define a smooth, continuous surface adjacent the plate.

7. The seater of claim 1 Wherein the limiting means comprises:
- a set member threaded with the rod;
- one axially facing reference surface on the set member;
- another axially facing reference surface on the terminus opposed to the third reference surface.

8. The seater of claim 1 wherein the rotating means comprises:
- a crank on the rod;
- a shank of the crank radially translatable with respect to the rod.

9. The seater of claim 5 wherein the locating means further comprises:
- an annulus fixed to the plate and disposed about the tube;
- external threads on the annulus;
- internal threads of the breech complimentary to the external threads;
- whereby the plate can be screwed onto the breech until the first reference surface bears upon the second reference surface.

10. The seater of claim 7 further comprising:

an angular position mark on the one reference surface;

an indicator marker on the set member.

11. The seater of claim 8 wherein:

the locating means comprises a plate on the tube having a first axially facing reference surface, and a second axially facing reference surface on the breech opposed to the first axially facing surface;

the limiting means comprises a set member threaded with the rod outside the tube, a third axially facing reference surface on the set member, and a fourth axially facing reference surface on the terminus opposed to the third reference surface;

an angular positional mark on one of the reference surfaces faces toward the crank, whereby the crank's angular position can be referenced to the mark.

12. A seater for repeatably accurate placement of launch package elements in a breech of a gun, comprising:

a breech longitudinal axis;

a tube closely fit within the breech and slidable along the axis;

a plate on the tube having a first axially facing reference surface;

a second axially facing reference surface on the breech opposed to the first axially facing surface;

an internally threaded terminus fixed to one end of the tube, outer diameters of the tube and terminus defining a smooth, continuous surface adjacent the plate;

a rod threaded with the terminus passing into the tube;

a seat member axially fixed relative to the rod, the seat member being closely fit with and slidable within the breech;

a guide between the seat member and the rod, the guide closely fit within the tube;

a stem connecting the guide to the seat member;

a head fixed to the stem and rotatably connected to the seat member, whereby the head and the seat member can rotate relative to one another about the axis;

a set member threaded with the rod outside the tube;

a third axially facing reference surface on the set member;

a fourth axially facing reference surface on the terminus opposed to the third reference surface.

13. The seater of claim 12 further comprising:

an annulus fixed to the plate and disposed about the tube;

external threads on the annulus;

internal threads of the breech complimentary to the external threads;

whereby the plate can be screwed onto the breech until the first reference surface bears upon the second reference surface.

14. The seater of claim 13 further comprising:

a shank on the rod, a shank portion-extending out from the rod;

an angular position mark on one of the reference surfaces faced toward the shank portion, whereby the angular position of the shank portion can be referenced to the mark.

15. A seater for repeatable placement of launch package elements in tight engagement within a breech of a gun at a selected position within the breech, comprising:

a breech longitudinal axis;

a tube slidable in the breech along the axis;

an internally threaded terminus at one end of the tube;

a rod threaded through terminus;

means for locating the tube with respect to the breech, the locating means comprising a first axially facing reference surface fixed to the tube and a second axially facing reference surface on the breech opposed to the first axially facing surface;

a seat member axially fixed relative to the rod, the seat member being slidable within the breech;

means for rotating the rod and axially translating the seat member;

means for limiting the travel of the rod and seat member relative to the tube.

16. The seater of claim 15 wherein the tube and seat member both have outer diametrical surfaces fitting congruently with against an inner diametrical wall of the breech.

17. The seater of claim 15, further comprising:

a guide between the seat member and the rod closely fit within the tube;

a stem connecting the guide to the seat member.

18. The seater of claim 15 wherein the limiting means comprises:

a set member threaded with the rod;

one axially facing reference surface on the set member;

another axially facing reference surface on the terminus opposed to the one reference surface;

an angular position mark on the one reference surface;

an indicator marker on the set member.

19. The seater of claim 15 wherein the rotating means comprises a crank on the rod.

* * * * *